US010940524B2

(12) United States Patent
Kohl et al.

(10) Patent No.: US 10,940,524 B2
(45) Date of Patent: Mar. 9, 2021

(54) METHOD FOR CONNECTING AT LEAST TWO COMPONENTS AND DEVICE FOR CARRYING OUT SUCH A METHOD

(71) Applicant: Daimler AG, Stuttgart (DE)

(72) Inventors: Daniel Kohl, Kirchheim (DE); Holger Schubert, Neckarsulm (DE); Matthias Wagner, Tuebingen (DE)

(73) Assignee: Daimler AG, Stuttgart (DE)

( * ) Notice: Subject to any disclaimer, the term of this patent is extended or adjusted under 35 U.S.C. 154(b) by 101 days.

(21) Appl. No.: 15/312,994

(22) PCT Filed: May 21, 2015

(86) PCT No.: PCT/EP2015/001033
§ 371 (c)(1),
(2) Date: Nov. 21, 2016

(87) PCT Pub. No.: WO2015/176819
PCT Pub. Date: Nov. 26, 2015

(65) Prior Publication Data

US 2017/0189954 A1 Jul. 6, 2017

(30) Foreign Application Priority Data

May 22, 2014 (DE) ..... 10 2014 007 553.2

(51) Int. Cl.
*B21J 15/02* (2006.01)
*B21J 15/28* (2006.01)

(52) U.S. Cl.
CPC ..... *B21J 15/025* (2013.01); *B21J 15/285* (2013.01)

(58) Field of Classification Search
CPC ..... B21J 15/025; B21J 15/285; B23P 19/02; B23P 19/062; B29C 65/565; B29C 66/93441
See application file for complete search history.

(56) References Cited

U.S. PATENT DOCUMENTS 6,014,802 A * 1/2000 Guerin ..... B21J 15/10 29/407.01
6,527,491 B1 3/2003 Uchimoto et al.
6,789,309 B2 * 9/2004 Kondo ..... B21J 15/025 29/243.53
6,951,052 B2 * 10/2005 Clew ..... B21J 15/025 29/243.53

(Continued)

FOREIGN PATENT DOCUMENTS

CN 101384827 A 3/2009
CN 101934337 A 1/2011

(Continued)

OTHER PUBLICATIONS

Machine Translation of DE-102010006404-A1 (Year: 2011).*

(Continued)

*Primary Examiner* — Jacob J Cigna
*Assistant Examiner* — Michael W Hotchkiss
(74) *Attorney, Agent, or Firm* — Crowell & Moring LLP

(57) ABSTRACT

A method for connecting a first component to at least one second component by at least one joining element which is introduced into the components at a joining point. The joining element is pushed into the components by an industrial robot at a speed of less than five meters per second.

4 Claims, 2 Drawing Sheets

(56) References Cited

U.S. PATENT DOCUMENTS

| | | | | |
|---|---|---|---|---|
| 10,005,120 | B2 * | 6/2018 | Trinick | B21J 15/025 |
| 10,384,295 | B2 * | 8/2019 | Draht | B21J 15/025 |
| 2002/0029450 | A1 * | 3/2002 | Kondo | B21J 15/025 29/407.01 |
| 2002/0078557 | A1 * | 6/2002 | Watanabe | B23P 19/006 29/714 |
| 2006/0042349 | A1 * | 3/2006 | Kernosky | B21J 15/36 72/470 |
| 2006/0230609 | A1 * | 10/2006 | Wang | B21J 15/08 29/798 |
| 2007/0101785 | A1 * | 5/2007 | Peckham | B21J 15/285 72/17.2 |
| 2008/0250832 | A1 * | 10/2008 | Sanchez-Brunete Alvarez | B21J 15/043 72/17.3 |
| 2011/0173803 | A1 * | 7/2011 | Naito | B21J 15/025 29/798 |
| 2012/0167366 | A1 * | 7/2012 | Mauer | B21J 15/025 29/407.08 |
| 2013/0205574 | A1 * | 8/2013 | Doo | B21J 15/025 29/524.1 |
| 2015/0258624 | A1 * | 9/2015 | Draht | B23K 11/11 403/267 |
| 2018/0311721 | A1 * | 11/2018 | Trinick | B21J 15/025 |

FOREIGN PATENT DOCUMENTS

| | | | | |
|---|---|---|---|---|
| CN | 103600016 | A | 2/2014 | |
| DE | 10 2006 002 237 | A1 | 7/2007 | |
| DE | 10 2006 007 706 | A1 | 8/2007 | |
| DE | 10 2009 009 112 | A1 | 11/2010 | |
| DE | 10 2007 033 126 | B4 | 6/2011 | |
| DE | 10 2010 006 404 | A1 | 8/2011 | |
| DE | 102010006404 | A1 * | 8/2011 | B21J 15/025 |
| DE | 102006002237 | B4 * | 9/2012 | B21J 15/28 |
| DE | 102012021817 | A1 * | 5/2014 | B23K 11/0066 |
| DE | 10 2012 013 325 | A1 | 10/2014 | |
| DE | 102012013325 | A1 * | 10/2014 | B21J 15/02 |
| EP | 2 754 512 | A1 | 7/2014 | |
| FR | 2 809 780 | A1 | 12/2001 | |
| WO | WO 2011/047862 | A1 | 4/2011 | |
| WO | WO-2014/013232 | * | 1/2014 | B21J 15/02 |
| WO | WO 2014/013232 | A1 | 1/2014 | |

OTHER PUBLICATIONS

Machine Translation of DE-102012013325-A1 (Year: 2014).*
Machine Translation of DE-102006002237-B4 (Year: 2012).*
DE-102012021817-A1 machine translation (Year: 2014).*
PCT/EP2015/001033, International Search Report dated Oct. 6, 2015 (Three (3) pages).
Chinese Office Action issued in Chinese counterpart application No. 201580026154.0 dated Nov. 24, 2017, with partial English translation (Twelve (12) pages).
Chinese Office Action issued in Chinese counterpart application No. 201580026154.0 dated Aug. 6, 2018, with partial English translation (Sixteen (16) pages).
Chinese Office Action issued in Chinese counterpart application No. 201580026154.0 dated Jan. 9, 2019, with partial English translation (Fourteen (14) pages).

* cited by examiner

METHOD FOR CONNECTING AT LEAST TWO COMPONENTS AND DEVICE FOR CARRYING OUT SUCH A METHOD

BACKGROUND AND SUMMARY OF THE INVENTION

The invention relates to a method for connecting at least two components and a device for carrying out such a method.

Such a method for connecting at least two components and a device for carrying out such a method can, for example, be gleaned as known from DE 10 2007 033 126 B4. In the method, the at least two components are connected to each other by means of at least one joining element in the form of a nail, wherein the joining element is introduced into the components at a joining point. Here, the nail is driven into the components at high speed, wherein the speed is between five and three hundred meters per second.

DE 10 2006 002 237 A1 also discloses a method for connecting a first component to at least one second component by means of at least one nail which is introduced into the components at a joining point. Here, the nail is driven into the components at a speed, wherein the speed is between ten meters per second and one hundred meters per second.

Finally, a method for producing a nail connection between at least two components which are not pre-punched in a joining region by means of a nail introduced into the components by a setting device to be substantially free of rotation is known from DE 10 2010 006 404 A1. Here it is provided that, in a first method step, the nail is firstly driven only partially into the components in the joining region up to an intermediate position, by means of a sudden movement at high speed. Then, in a second method step, the nail is pushed completely into the components into an end position. In the second method step, the nail is pushed into the end position at a speed, wherein the speed in the second method step is lower than the speed in the first method step.

The nail can be formed as a bolt or a setting bolt, wherein the known methods are also referred to as bolt setting or as bolt setting methods. These methods are also known by the term Rivtac or Impact. The conventional methods are very cost- and noise-intensive.

The object of the present invention is therefore to create a method and a device of the type referred to at the beginning, by means of which the components can be connected to each other in a particularly cost-effective and low-noise manner.

In order to create a method by means of which the components can be connected to each other in a particularly cost-effective and low-noise manner, it is provided according to the invention that the joining element is pushed into the components by means of an industrial robot at a speed of less than five meters per second. The invention recognizes that, using conventional methods formed as high-speed joining methods, the joining element is driven into the components at a very high speed which is also referred to as a setting speed, wherein for this purpose complex and therefore particularly cost-intensive systems are required, for example in the form of bolt setting systems. In order to drive the joining element formed, for example, as a nail into the components at the high speed, cost-intensive bolt guns and/or powder-actuated cartridges are usually required. Furthermore, due to the high speed, noise levels of over 130 decibels usually occur. This high noise level is generated by vibrations which result from high setting speeds at which the joining element usually strikes the components. Due to these high noise levels, cost-intensive and inflexible sound-insulating cabins are usually used.

Since, with the method according to the invention, the speed, i.e., the setting speed, of the joining element is particularly low, the use of cost-intensive systems and sound-insulating cabins is not required.

Additionally, it has been discovered that, despite the use of the only very low speed with which the joining element is pushed into the components, the stiffness requirements for the components are particularly low. Therefore, the components are connected to each other particularly firmly by means of the method according to the invention. Additionally, the expense of a sensor system for monitoring the method can be kept low in comparison to conventional methods.

The invention also includes a device wherein, to achieve a cost-effective and low-noise connection of the components, it is provided according to the invention that the device is formed to push the joining element into the components with a speed of less than five meters per second. Advantageous embodiments of the method according to the invention are specified as advantageous embodiments of the device according to the invention and vice versa.

The joining element is, for example, a nail or a screw or a rivet which is pushed into the components such that the nail or the screw or the rivet penetrates the components. The nail can be a bolt which is also referred to as a setting bolt. Therefore, the method is embodied, for example, as a bolt setting method, in which the nail (bolt) is pushed into the components at an only very low speed of less than five meters per second. Excessive vibrations and noises resulting from the vibrations can thereby be prevented. Additionally, a system by means of which the nail is pushed into the components can be designed particularly simply and therefore cost-effectively.

Further advantages, features and details of the invention result from the description below of preferred exemplary embodiments as well as by means of the drawings.

BRIEF DESCRIPTION OF THE DRAWINGS

FIG. 2 is a schematic and perspective side view of a device in the form of a drop tower for carrying out the method referred to.

DETAILED DESCRIPTION OF THE DRAWINGS

Figure 2:
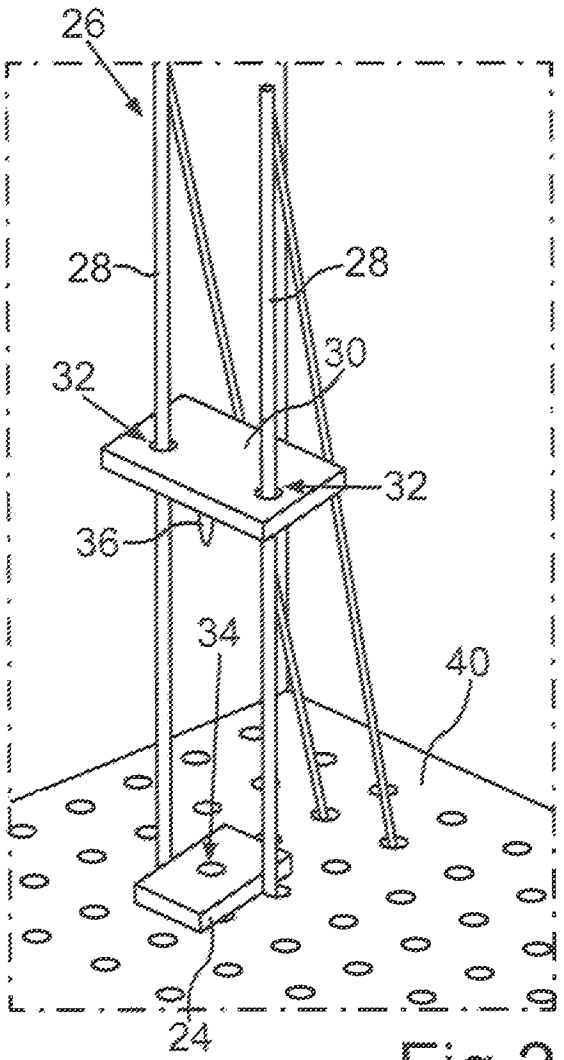

In the Figures, identical or functionally identical elements are provided with the same reference numerals.

Figure 1:
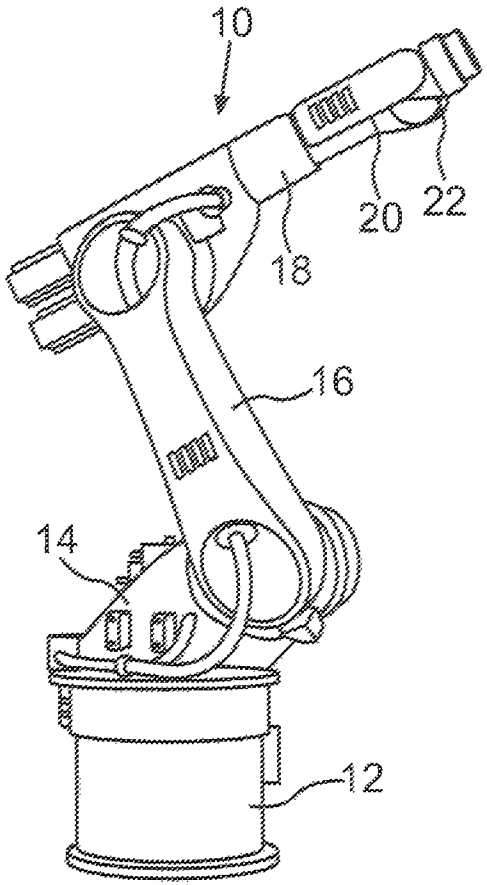
FIG. 1 is a schematic and perspective side view of an industrial robot for carrying out a method for connecting at least two components in which a joining element in the form of a nail is pushed into the components by means of the robot at a speed of less than five meters per second.

FIG. 1 shows, in a schematic perspective side view, a device in the form of an industrial robot 10 for carrying out a method in the scope of which a first component is connected to at least one second component, in particular of a motor vehicle. The components are, for example, vehicle body parts. The industrial robot 10 has a base 12, via which the industrial robot 10 is fastened to the floor. Additionally, the industrial robot 10 has a plurality of robot arms 14, 16, 18 and 20 which are also referred to as axes or robot axes.

Additionally, the industrial robot 10 comprises a robot head 22 held in a moveable manner on the robot arm 20. The robot arms 14, 16, 18, 20 and the robot head 22 are connected to each other flexibly, such that these can be moved relative to one another.

A device which is not depicted in FIG. 1 is arranged on the robot head 22, such that this device can be moved around in space by means of the industrial robot 10. It is thereby possible, for example, by means of the industrial robot 10, to connect the components to each other by means of at least one joining element in the form of a nail, wherein, in the scope of the method, the nail is introduced, i.e., is pushed, into the components at a joining point by means of the industrial robot 10.

Before the introduction of the nail, the components are arranged, for example, relative to each other in such a way that the components overlap each other at least in a respective overlapping region. Here, the joining point is arranged in the overlapping regions such that the nail penetrates the overlapping regions.

In order to now connect the components to each other in a particularly cost-effective and low-noise manner, it is provided that the nail is pushed into the components by means of the industrial robot 10 at a speed of less than five meters per second. The structure of the industrial robot 10 as well as the control thereof can hereby be kept particularly simple. Additionally, excessive vibrations of the components and excessive noise resulting therefrom can also be prevented by this low speed which is also referred to as a setting speed.

The nail is, for example, a bolt which is also referred to as a setting bolt. The method is therefore formed as bolt setting or a bolt setting method, in which the bolt is driven into the components at an only very low speed, i.e., particularly slowly. The industrial robot 10 here represents an electrical drive, by means of which the nail, which is also referred to as a tack, is pushed into the components directly and slowly.

Alternatively to the industrial robot 10, it is also conceivable to use another electromechanical device, by means of which the nail is pushed into the components. Furthermore, it is possible to push the nail (joining element) into the components by means of a pneumatic device or a hydraulic device, or to push the nail (joining element) into the components by means of an accelerated mass.

Additionally, a holder can be used for pushing the nail into the components. Such a holder is a device for holding and for isolating the nail. The holder has a predeterminable mass, wherein the holder and with this the nail is accelerated to a predeterminable speed of less than five meters per second. It is thereby possible to drive the nail into the components, which represent a component composite. The nail can hereby be pushed into the components with particularly high energy.

Such a holder can, for example, be arranged on the industrial robot 10, in particular on the robot head 22, such that the holder and the nail are able to be moved around in space by means of the industrial robot 10. Here, a movement of the nail which is decoupled from the industrial robot 10 and is able to be caused by the holding device can be achieved. For example, the holder has a guide carriage, by means of which the nail can be moved relative to the industrial robot 10 and therefore at least substantially independently of this. It can thereby, for example, be achieved that a force acting on the nail during the driving in thereof is not transferred to the industrial robot 10.

A pneumatic or hydraulic press can be used, for example, for driving in the nail. Additionally, the use of an automated hammer, a pulse drive or a servo drive is conceivable for pushing in the nail.

The driving of the joining element into the components can, for example, occur in a multi-step joining procedure. Additionally, the driving of the joining element into the components can occur by means of at least two different joining devices. For example, the joining element can firstly be pushed only partially into the components up to an intermediate point by means of an automated hammer and then, in a second method step, can be pushed completely into an end position by means of an industrial robot.

FIG. 2 shows a device according to a further embodiment, by means of which the nail can be driven into the components. In FIG. 2, one of the components, which is referred to in FIG. 2 by 24, is depicted to illustrate the driving in of the nail. The device shown in FIG. 2 is formed as a drop tower 26. The drop tower 26 comprises two guide elements which are presently formed as guide rods 28. Furthermore, the drop tower 26 comprises a guide carriage in the form of a guide plate 30 which has through-openings 32. Here, the guide rods 28 penetrate the corresponding through-openings 32 such that the guide plate 30 is able to move relative to the guide rods 28 in a translational manner along the guide rods 28.

The joining point at which the nail is pushed into the component 24 is referred to in FIG. 2 by 34. Additionally, the nail is depicted particularly schematically in FIG. 2 and referred to by 36.

In order to push the nail 36 into the component 24 at the joining point 34, the guide plate 30 is moved away from the component 24 along the guide rods 28. The guide plate 30 has a predeterminable mass. The nail 36 also has a predeterminable mass. The predeterminable mass of the nail 36 and the predeterminable mass of the guide plate 30 form a total mass. The guide plate 30 and with this the nail 36 held on the guide plate 30 are moved away from the component 24 in such a way that a predeterminable distance is set between the nail 36 and the component 24. This distance is here set in such a way that the nail 36 has a speed of less than five meters per second when it strikes the component 24 and penetrates this.

After the distance has been set, the guide plate 30 is released such that the guide plate 30 and the nail 36 are accelerated only due to gravity to the settable speed of less than five meters per second. In other words, in the case of the drop tower 26, the guide plate 30 is allowed to fall with the nail 36 via gravity, whereby the energy for the joining procedure is provided. For example, the guide plate 30 has a mass of three kilograms, wherein the determined height or the distance between the component 24 and the nail 36 is set, for example, to one meter.

Figure 3:
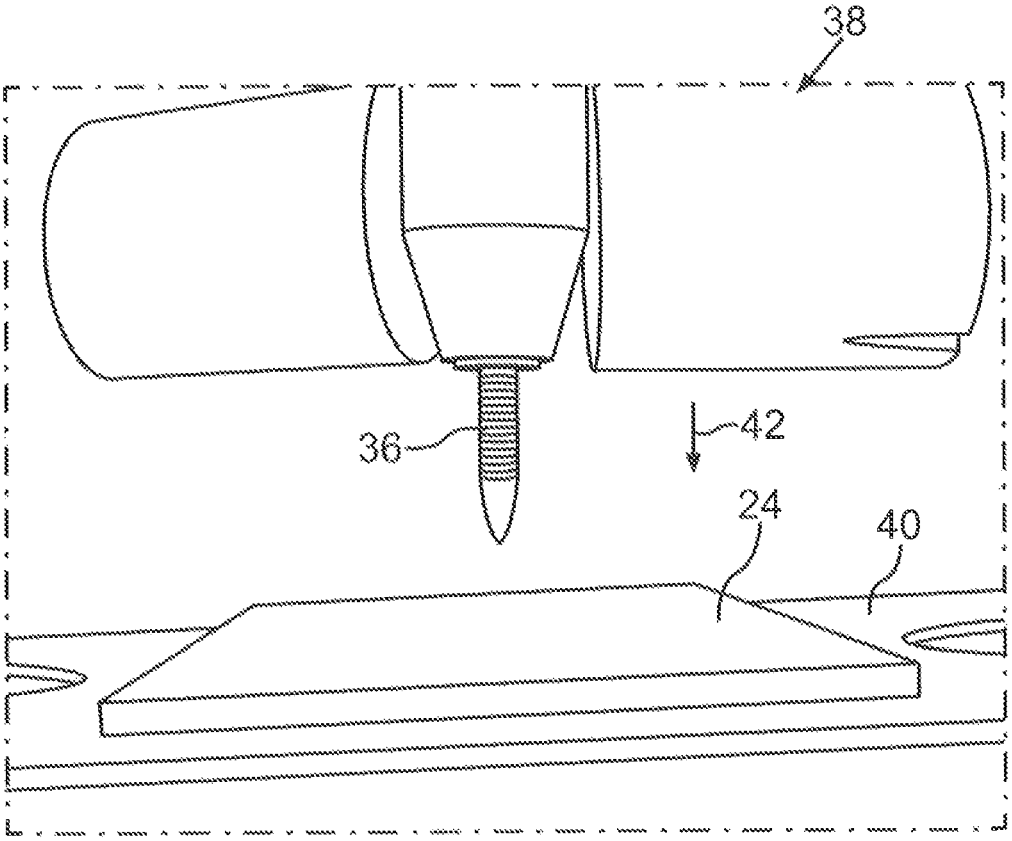
FIG. 3 is a further schematic and perspective side view of a further device for carrying out the method, in which the joining element in the form of the nail is pushed into the components at a speed of less than five meters per second.

FIG. 3 shows a further device 38 for pushing in the nail 36 at a speed of less than five meters per second. In FIGS. 2 and 3, a counter holder 40 is also recognizable on which the component 24 is supported. The counter holder 40 is used so that the component 24 or the components cannot evade the nail 36 in the driving-in direction thereof, but rather the nail 36 can penetrate the components. By means of the device 38, the nail 36 is pushed into the components in the driving-in direction at a speed of less than five meters per second, wherein the driving-in direction is illustrated in FIG. 3 by a directional arrow 42. The device 38 can be formed as a pneumatic device, hydraulic device or electromechanical device.

In the scope of the method, the nail 36 is firstly arranged and held on the device 38. Then, the nail 36 is pushed into the components in the driving-in direction by means of the device 38, wherein the component referred to with 24 is recognizable from the components in FIG. 3. Since, due to the low setting speed, excessive vibrations and noise are prevented, the use of cost-intensive and inflexible sound-insulating walls and sound-insulating cabins can be dispensed with. As a consequence, a particularly low cycle time can also be achieved, which is usually lengthened by doors of the sound-insulating cabins having to be opened and/or turntables having to be rotated or component feeds having to be moved. This can now be prevented such that, for example, in the scope of mass production, a particularly high number of components can be connected to one another in a particularly short time.

In addition to the joining procedure shown in the exemplary embodiments, in which a first component 24 is connected to at least one second component by means of at least one joining element 36 which is introduced into the components 24 at a joining point 34, wherein the joining element 36 is pushed into the components 24 by means of an industrial robot 10 at a speed of less than five meters per second, the method and the device 10, 26, 38 can also be used only for post-processing a head protrusion or a joining element 36 which is not completely pushed into the components 24.

The invention claimed is:

1. A method for preventing evasion of a nail while connecting a first component to a second component by the nail, the nail being introduced into the first and second components at a joining point, comprising the steps of:

supporting the first and second components on a counter holder; and pushing the nail into the first and second components in a multi-step joining procedure while supporting the first and second components on a surface of the counter holder facing the nail, wherein in a first step of the multi-step joining procedure the nail is pushed by a first joining device toward the surface of the counter holder and only partially into the first and second components up to an intermediate point only at a speed of less than five meters per second and in a second step of the multi-step joining procedure the nail is pushed by a second joining device toward the surface of the counter holder and from the intermediate point completely into an end position in the first and second components only at the speed of less than five meters per second.

2. The method according to claim 1, wherein the speed is 0.01 meters per second to 2 meters per second.

3. The method according to claim 1, wherein the first joining device is an industrial robot.

4. The method according to claim 3, wherein the industrial robot has a base, a plurality of arms, and a head, wherein the head and the plurality of arms are movable relative to one another.

* * * * *